US005430967A

United States Patent [19]

Woodman, III et al.

[11] Patent Number: 5,430,967

[45] Date of Patent: Jul. 11, 1995

[54] AIMING ASSISTANCE DEVICE FOR A WEAPON

[75] Inventors: Wallace E. Woodman, III, Merrimack; Timothy Loring, Brookline; Kenneth S. Solinsky, Beford, all of N.H.

[73] Assignee: Insight Technology, Inc., Londonderry, N.H.

[21] Appl. No.: 167,058

[22] Filed: Dec. 16, 1993

[51] Int. Cl.[6] ..... F41G 1/34

[52] U.S. Cl. ..... 42/103; 362/110

[58] Field of Search ..... 42/103, 101, 98, 49.01, 42/50, 72, 73; 362/110, 113, 114; 89/1.42, 14.3

[56] References Cited

U.S. PATENT DOCUMENTS

| | | | |
|---|---|---|---|
| 933,095 | 9/1909 | Mosteller | 42/103 |
| 1,057,318 | 4/1913 | Archer | 42/103 |
| 1,222,778 | 4/1917 | McCleary | 42/73 |
| 1,262,270 | 4/1918 | Schmidt et al. | 362/110 |
| 1,865,127 | 6/1932 | McKeen . | |
| 1,877,016 | 9/1932 | Munson | 42/72 |
| 2,085,732 | 7/1937 | Baxter et al. | 42/103 |
| 2,158,915 | 5/1939 | Scarcy . | |
| 2,236,736 | 4/1941 | Scott | 362/110 |
| 2,385,649 | 9/1945 | Prideaux . | |
| 2,529,057 | 11/1950 | Teffault . | |
| 2,546,242 | 3/1951 | Stinson . | |
| 2,597,565 | 5/1952 | Chandler et al. . | |
| 3,019,542 | 2/1962 | Manthos | 42/50 |
| 3,222,022 | 12/1965 | Akin, Jr. | 42/101 |
| 3,562,944 | 2/1971 | Wagner et al. | 42/50 |
| 3,742,636 | 7/1973 | Dealy et al. | 33/233 |
| 4,069,414 | 1/1978 | Bell | 362/110 |
| 4,281,993 | 8/1981 | Shaw | 434/22 |
| 4,295,289 | 10/1981 | Snyder | 362/113 |
| 4,310,980 | 1/1982 | Pilkington | 42/101 |
| 4,446,644 | 5/1984 | Jimenez et al. | 42/101 |
| 4,554,744 | 11/1985 | Huckenbeck | 356/251 |
| 4,571,870 | 2/1986 | Heideman et al. | 42/103 |
| 4,658,139 | 4/1987 | Brennan et al. | 356/251 |
| 4,665,622 | 5/1987 | Idan | 33/246 |
| 4,697,226 | 9/1987 | Verdin | 42/103 |
| 4,777,754 | 10/1988 | Reynolds, Jr. | 42/103 |
| 4,856,218 | 8/1989 | Reynolds, Jr. | 42/103 |
| 4,876,815 | 10/1989 | Terrill | 42/100 |
| 4,876,816 | 10/1989 | Triplett | 42/103 |
| 4,894,941 | 1/1990 | Karow, Jr. | 42/103 |
| 4,905,396 | 3/1990 | Bechtel | 42/100 |
| 4,926,576 | 5/1990 | Maes et al. | 42/103 |
| 4,934,085 | 6/1990 | Lough | 42/103 |
| 5,040,322 | 8/1991 | Iturrey, Jr. | 42/103 |
| 5,064,988 | 11/1991 | E/nama et al. | 42/103 |
| 5,111,587 | 5/1992 | Plank | 33/247 |

FOREIGN PATENT DOCUMENTS

| | | | |
|---|---|---|---|
| 2592149 | 6/1987 | France . | |
| 818524 | 8/1959 | United Kingdom | 362/110 |
| 2052025 | 1/1981 | United Kingdom | 42/103 |

OTHER PUBLICATIONS

*Sentinel*, Heckler & Koch, Inc. USA, 1993 Issue, pp. 1–24.

*Primary Examiner*—Stephen M. Johnson
*Attorney, Agent, or Firm*—Baker & Botts

[57] ABSTRACT

A clamping mechanism is provided for attaching an auxiliary apparatus to a weapon having a frame. The clamping mechanism has projections which are biased by a flexible member toward corresponding recessed portions formed in the frame of the weapon. A retaining member is also provided which may be moved between an open and a closed position. In the closed position, the flexibility of the flexible member is minimized, such that the projections of the clamping mechanism are locked against the corresponding recessed portions of the weapon. In the open position, the flexible member may bend away from the weapon thereby disengaging the projections of the clamping mechanism from the recessed portions of the weapon. A battery housing is also provided for receiving a battery casing which holds one or more batteries. The batteries are provided for energizing the auxiliary apparatus. The battery housing has a cavity formed therein. A recessed portion is provided in the surface of the cavity for receiving a projection formed in the battery casing. A spring member is provided for biasing the projection of the battery casing toward the recessed portion of the cavity to maintain the battery housing in a closed position.

16 Claims, 7 Drawing Sheets

AIMING ASSISTANCE DEVICE FOR A WEAPON

BACKGROUND OF THE INVENTION

1. Field of the Invention

The invention relates generally to an aiming assistance device and, more particularly, to attaching an aiming assistance device to a weapon.

2. Background of the Invention

The need to effectively direct weapon fire at a target is well recognized. To do this, it is helpful to be able to see the target and to be able to aim the weapon in the direction of the target. To facilitate seeing the target, numerous devices have been invented for mounting a flashlight or other illuminators on a weapon for illuminating the target area. To facilitate aiming a weapon, numerous devices have been invented for mounting a laser on a weapon, thereby creating an aim point for the weapon.

Numerous systems have been developed for attaching aiming assistance devices such as scopes, illuminators, lasers, or combined illuminator/laser units to weapons. For convenience, these devices may be referred to as auxiliary devices. These systems typically require separate brackets or other mechanical components, which necessitate tools, e.g. screwdrivers, coins, or bullets, for attaching and detaching the device itself or the mechanical component. Alternatively, attaching and detaching the devices or mechanical components requires partial disassembly or modification of the weapon. Further, such systems typically require use of two hands to mount the device on the weapon, both hands performing a function beyond merely gripping the weapon. This requirement presents several disadvantages. For instance, the user may be forced to remove his trigger hand from the trigger area of the weapon. Moreover, attachment and detachment of these devices is relatively time consuming.

As a result of these and other problems with conventional aiming assistance devices, the user typically leaves the auxiliary device mounted on the weapon or performs a time consuming operation to mount the device when needed. These alternatives are undesirable. For example, if the device is left mounted on the weapon, it cannot be used independently of the weapon despite the fact that many situations call for illuminating an area without pointing a weapon toward that area. Also, in the context of handguns, for example, holsters are not readily available to accommodate weapons having such devices mounted thereon. Thus, it is often difficult to carry a weapon having such a device attached to it. This presents special problems for law enforcement officers. Additionally, the user may not want to use the device during daylight hours, but may want to attach the device to a weapon at night. Further, the user may want to be able to readily remove the device when it is no longer needed. Moreover, depending on the configuration of the device, the user may need to replace its batteries. Preferably, the user should be able to perform this procedure quickly without the need for tools.

Another problem with conventional auxiliary devices is that the device is often much wider than the weapon or the device protrudes substantially beyond the front end of the weapon. These characteristics often result in subjecting the device to greater wear and tear because the device often contacts various obstructions in the environment where the weapon is being used. For instance, a device extending substantially beyond the end of a barrel of a weapon may catch on doorways, clothing, tree branches, or other objects tending to tear the device apart from the weapon and possibly damaging, or rendering inoperable, the device or the weapon itself. Another problem is that an assailant may more easily disarm a user by grabbing an aiming device which extends substantially beyond the weapon. The danger of these and other problems occurring would be particularly great at night or when ordinary vision is otherwise impaired.

Additionally, many prior auxiliary devices, especially illuminators, are bulky. This characteristic is undesirable.

These disadvantages are not intended to be exhaustive, and those with ordinary skill in the art will appreciate that other disadvantages of conventional auxiliary devices and systems for attaching those devices are readily apparent.

SUMMARY OF THE INVENTION

It is an object of the present invention to provide an aiming assistance device such as a scope, illuminator, laser, or combination thereof, with a mechanism for attaching the device to a weapon, such that the actual attachment or removal can be accomplished by a user with one hand, while the second hand merely grips the weapon.

It is a further object of the invention to provide a means for attaching such a device without the assistance of tools.

It is a further object of the present invention to provide a mechanism for mounting such a device without separate brackets or other mechanical components.

It is a further object of the present invention to provide a mechanism for mounting such a device without temporary or permanent disassembly of, or removal of any parts from, the weapon to which the device is to be attached.

It is a further object of the present invention to minimize the size of an auxiliary device, for example, by providing an auxiliary device which may be attached to the frame of a weapon such that when the device is attached to the weapon, protrusion of the device beyond the overall dimensions of the weapon is minimized. Preferably, the width of the auxiliary device does not extend beyond the overall width of the weapon. Also, the auxiliary device preferably does not protrude beyond the front end of the weapon.

It is a further object of this invention to provide a battery operated aiming assistance device in which the batteries can be easily and readily replaced and such replacement can be performed without tools. Additionally, replacement of the batteries may be achieved without detaching a main body of the auxiliary device from the weapon.

In one embodiment of the present invention, an aiming assistance device is provided with a clamping mechanism for attaching the device to a weapon. Preferably, the weapon has an exterior surface and at least one recessed portion formed in the exterior surface of the weapon. Preferably, the clamping mechanism comprises at least one projection which may extend from the body of the device and a biasing member for biasing the at least one projection against the at least one recessed portion of the weapon to attach the device to the weapon. Optionally, a retaining member is provided to selectively retain the biasing member in a position to ensure that the attachment is maintained until it is no longer desired. Preferably, the clamping mechanism has a fixed portion having a first projection and a moveable portion having a second projection extending toward the first projection.

In another embodiment of the present invention an aiming assistance device is provided for assisting the aiming of a weapon. The aiming assistance device comprises a housing and a battery casing. The housing has a cavity formed therein for receiving the battery casing. The battery casing has at least one projection extending from a surface thereof. Preferably, at least one recessed portion is formed in the surface of the cavity and a biasing member is provided for biasing the projection of the battery casing toward the recessed portion of the cavity. The housing is in a closed state when the projection of the battery casing is received in the recessed portion of the cavity.

The features of the foregoing embodiments may be combined and may comprise additional features including, but not limited to, the following.

The clamping mechanism preferably comprises at least one flexible member which may be made from any number of materials having spring properties, e.g. a beryllium copper alloy, plastic, or spring steel. The flexible member either engages, is connected to, or is integral with the projection of the clamping mechanism and tends to force the projection of the clamping mechanism toward the recessed portion of the weapon. A retaining member may be provided for selectively limiting the flexibility of the flexible member. Preferably, the retaining member is slidably disposed within a slot formed in the body of the clamping mechanism, such that the retaining member may be slid between an open, or downward, position and a closed, or upward position. In the closed position, the flexibility of the flexible member is minimized and the projection of the clamping mechanism is locked against the recessed portion of the weapon. In the open position, the flexibility of the flexible member is increased to enable it to be bent away from the weapon thereby disengaging the projection from the recessed portion of the weapon.

One feature of the foregoing embodiments is that the battery casing may be locked into the housing. This feature may be accomplished by a spring-type mechanism which applies a force to the battery casing and concurrently forces a projection of the battery casing into a recessed portion of the housing. To provide this force, the battery casing may have at least one flexible member integrally formed thereon. Alternatively, the surface of the battery casing of the aiming assistance device may comprise a flexible portion. In another embodiment the housing may have at least one flexible member integrally formed thereon or attached thereto.

The surface of the cavity may have a depression formed thereon which engages either a corresponding surface of at least one battery or a corresponding surface of the battery casing when the housing is in a closed state.

Preferably, the foregoing features are combined in one housing to minimize the overall size of the aiming assistance device and maximize the simplicity of attaching and detaching the device to and from a weapon.

Further objects, features, and advantages of the present invention will be understood from the detailed description of the preferred embodiments of the present invention with reference to the appropriate figures.

BRIEF DESCRIPTION OF THE DRAWINGS

FIG. 3 is a perspective view of the aiming assistance device of FIG. 1.

FIG. 4 is a perspective view of various components of the aiming assistance device of FIG. 1.

FIG. 5 is a detailed view of the aiming assistance device according to an embodiment of the present invention.

FIG. 7 is a cross-sectional view of the aiming assistance device of FIG. 6 taken along line A—A. FIG. 7C shows a battery casing surrounding a pair of batteries.

DETAILED DESCRIPTION OF THE PREFERRED EMBODIMENTS

Figure 1:
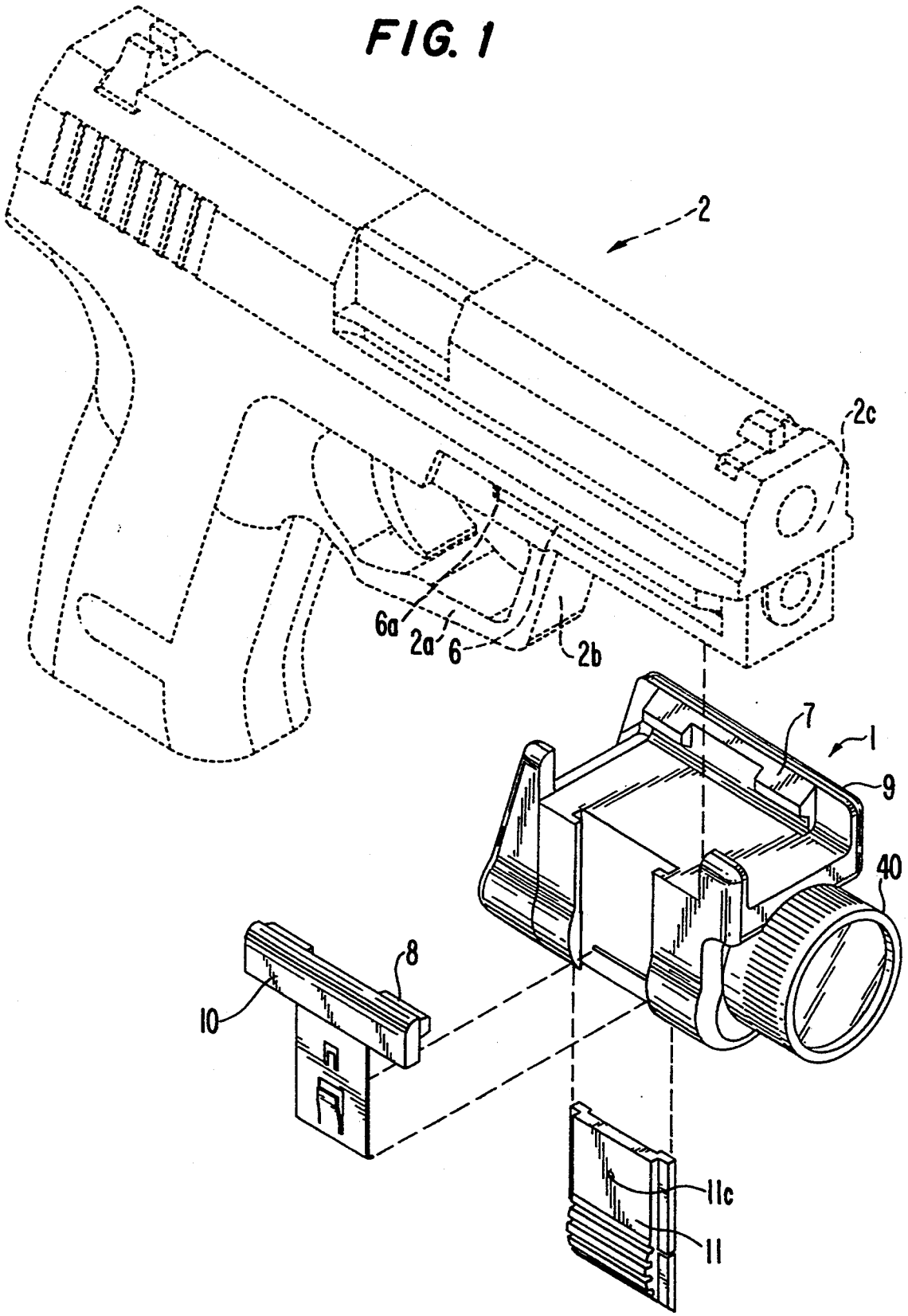
FIG. 1 is an exploded perspective view of an aiming assistance device and a phantom view of a weapon on which the device may be mounted in accordance with one embodiment of the present invention.

Referring to FIG. 1, an aiming assistance device is provided for attachment to a pistol-type weapon (shown in phantom). The aiming assistance device may actually be any number of auxiliary devices including, but not limited to, scopes, lasers, illuminators, and laser-/illuminator combinations. Additionally, it should be noted that the pistol-type weapon of FIG. 1 is for illustrative purposes only. The novel aiming assistance device described herein may be attached to other weapons including, but not limited to, shotguns and rifles. For convenience, the description that follows refers to the aiming assistance device as an illuminator, which is a device generally used to cast light upon a target area. This should not be construed as a limitation of the invention, however, as this reference is for illustrative purposes only. The novel features described herein may be applied to other auxiliary devices. Moreover, the figures are provided as examples only. It is to be understood that the invention is not limited to the particulars depicted in the figures.

According to one embodiment, an aiming assistance device is provided with an attachment mechanism to enable the device to be easily attached to, or detached from, a weapon. The weapon shown in phantom has grooves 6 formed thereon. A weapon of this type is commercially available to the user under the name of "USP" from Heckler & Koch, Inc. The aiming assistance device, for example, the illuminator of FIG. 1, is attached to the weapon by projections which engage the grooves formed on both sides of the weapon. Preferably, one projection is fixed relative to the housing of the aiming assistance device and another projection is movable relative thereto. As disclosed in more detail below, this enables the device to be easily snapped onto the weapon.

More specifically, referring to FIGS. 1–4, illuminator 1 is provided having a slot 14 formed therein. Illuminator 1 also comprises a light housing 40 with a lighting mechanism (not shown) located therein. Illuminator 1 has a first side flange 9 which preferably is fixed relative to housing 3 and second side flange 10 which is movable relative to housing 3. For example, flexible member 13 may be attached to, or formed integrally with, side flange 10. Member 13 may be designed to be disposed in slot 14. The flexibility of member 13 enables second side flange 10 to be movable. Preferably, a retaining member 11 is formed to fit over member 13 and retain member 13 in slot 14. Preferably, retaining member 11 is slidably disposed in slot 14 for selectively retaining member 13. Retaining member 11 may be slid between an open and closed position. When in a closed position, retaining member 11 limits the flexibility of member 13, thereby immobilizing or locking second side flange 10. Projections 7, 8 extend inwardly, toward each other, from flanges 9, 10, respectively. Projections 7, 8 are designed to be received by grooves 6 formed in weapon 2. By moving retaining member 11 to at least a partially open state, illuminator 1 may be snapped onto weapon 2 so that projections 7, 8 engage grooves 6. Then retaining member 11 may be moved to a closed state, causing projections 7, 8 to be securely locked into grooves 6 to secure illuminator 1 to weapon 2. Movement of the retaining member changes the free length of the flexible member thereby varying the bias on the projection 8.

Figure 2:
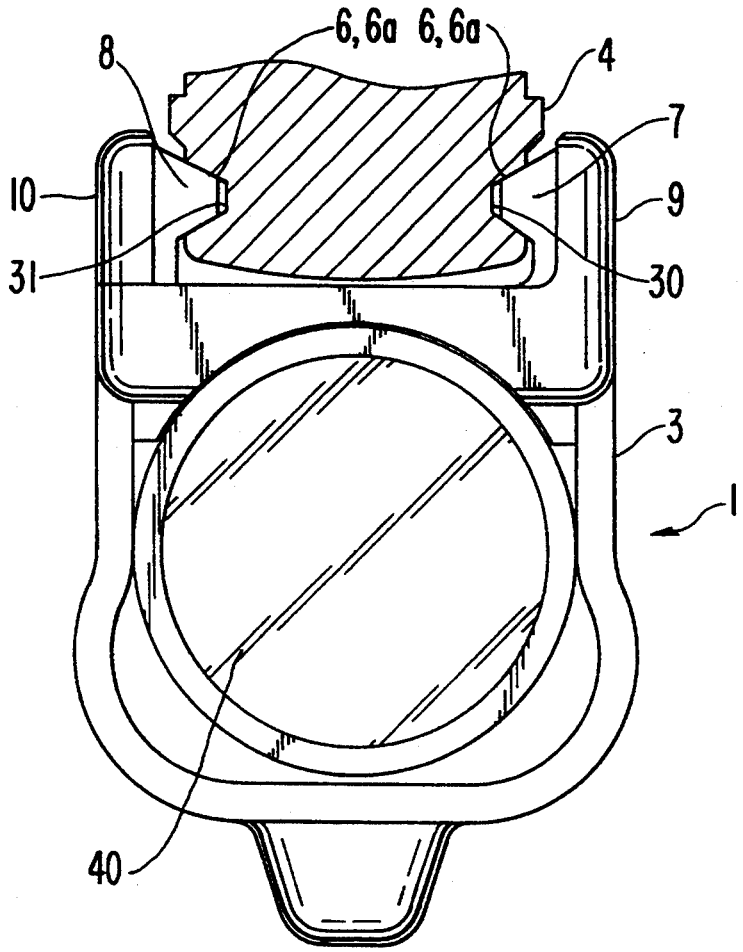
FIG. 2 is a plan view of the aiming assistance device of FIG. 1 mounted on the weapon.

These features will now be described in greater detail. Referring to FIGS. 1–2, an aiming assistance device, e.g. an illuminator 1, is provided according to one embodiment of the present invention. More particularly, illuminator 1 is designed to be mounted on a weapon 2. As best seen in FIG. 2, illuminator 1 has a housing 3 with a first side flange 9, which is preferably integrally formed thereon or attached thereto. First side flange 9 has a first projection 7 extending therefrom in a direction toward frame 4 of weapon 2. A second side flange 10 has a second projection 8 which extends therefrom in a direction toward frame 4 of weapon 2, i.e. toward first projection 7.

Figure 3A:
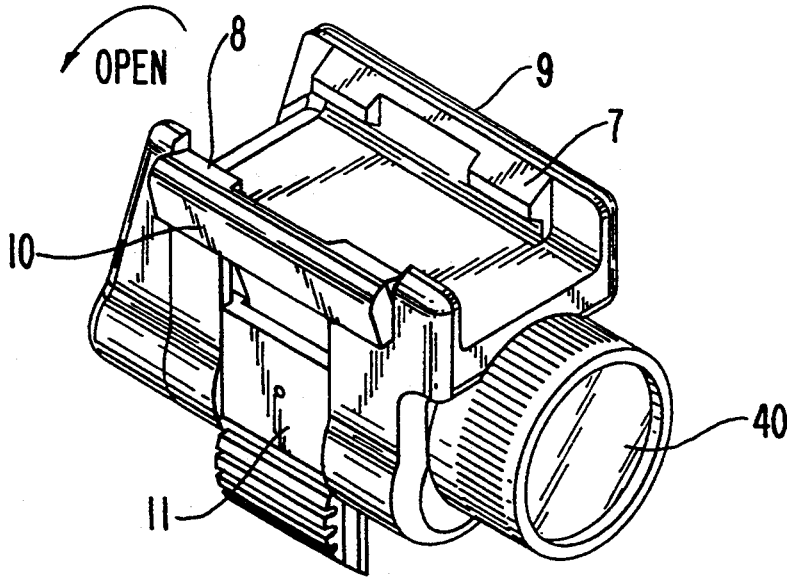
FIG. 3A shows the retaining member of the aiming assistance device in an open state.
Figure 3B:
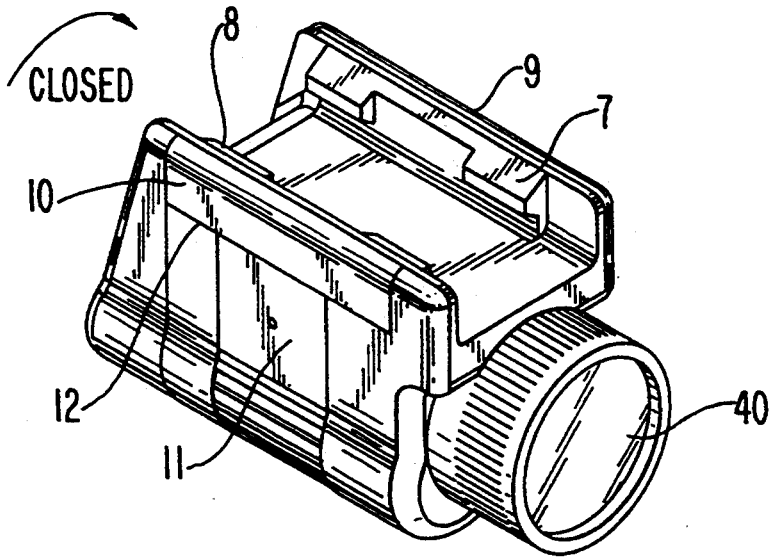
FIG. 3B shows the retaining member of the aiming assistance device in a closed state.

Also referring to FIGS. 3–4, flexible member 13 is preferably formed from a beryllium copper alloy and is provided with spring tabs **13*a*, 13*b* formed thereon. Second side flange 10 is preferably attached to, or formed integral with, member 13. Spring tabs 13*a*, 13*b* each have spring forces respectively associated therewith. Member 13 also has an end portion 13*c* which is formed to be received by groove 14*a* of slot 14. Preferably, end portion 13*c* is bent to provide a generally L-shaped configuration at the end of member 13**.

Figure 4A:
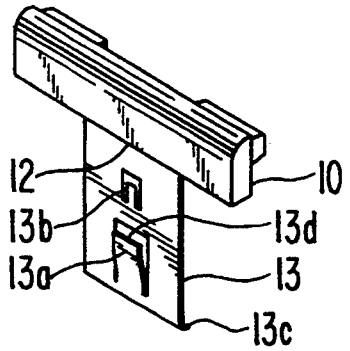
FIG. 4A shows a flexible member attached to a side flange.
Figure 4B:
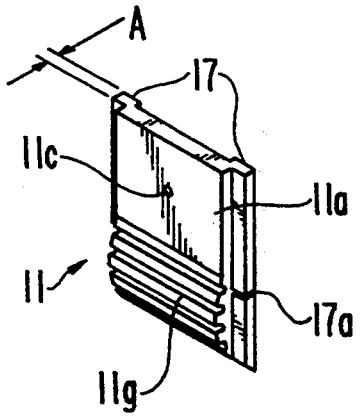
FIG. 4B depicts a side view of the outer surface of a retaining member which may be used with the aiming assistance device of FIG. 1.
Figure 4C:
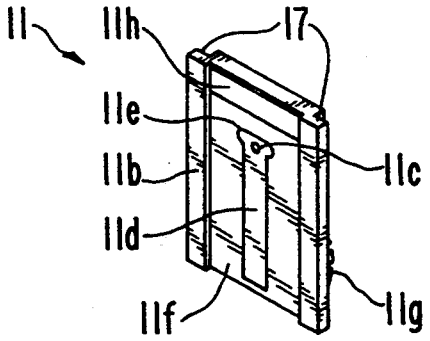
FIG. 4C depicts a side view of the inner surface of the retaining member of FIG. 4B.

Retaining member 11 has a front face **11*a* as depicted in FIG. 4B, and a back face 11*b*, as depicted in FIG. 4C. Retaining member 11 has flanges 17 formed thereon at its outer edges and a hole 11*c* formed therethrough. Flanges 17 preferably each have a notch 17*a* formed thereon adjacent to a thumb grip portion 11*g* which may be raised with respect to front face 11*a*. Back face 11*b* has first recessed portion 11*f* formed thereon and partially defined by flanges 17. A second recessed portion 11*d* is formed on first recessed portion 11*f* and dimensioned such that the width of second recessed portion 11*d* slightly exceeds the width of spring tab 13*a*, so that spring tab 13*a* of flexible member 13 may be disposed in second recessed portion 11*d*. Back face 11*b* also has slanted portion 11*h* which is slanted with respect to first recessed portion 11*f***.

Figure 4D:
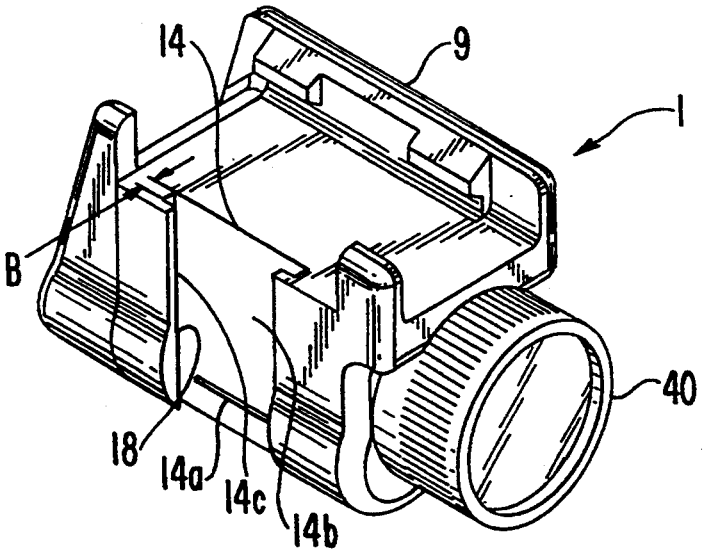
FIG. 4D depicts the aiming assistance device without the components depicted in FIGS. 4A, 4B, and 4C.

As depicted in FIG. 4D, illuminator 1 has slot 14 integrally formed therein opposite first side flange 9. Slot 14 has an inner surface **14*b* and an outer surface 14*c* associated therewith. Groove 14*a* is formed in inner surface 14*b* of slot 14. Notches 18 are formed in outer surface 14*c* of slot 14**.

Flexible member 13 is disposed in slot 14 as end portion **13*c* of member 13 is inserted into groove 14*a* of slot 14. When member 13 is disposed in slot 14 in this manner, spring tab 13*b* engages inner surface 14*b* of slot 14. The spring force associated with spring tab 13*b* tends to force member 13 away from inner surface 14*b* of slot 14**.

Figure 5C:
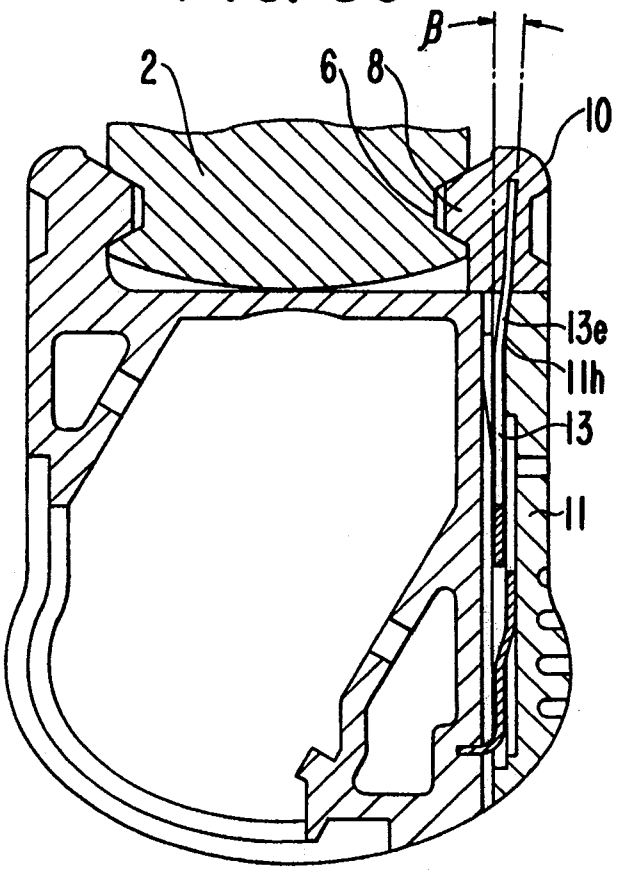
FIG. 5C shows the aiming assistance device in a closed state.
Figure 5B:
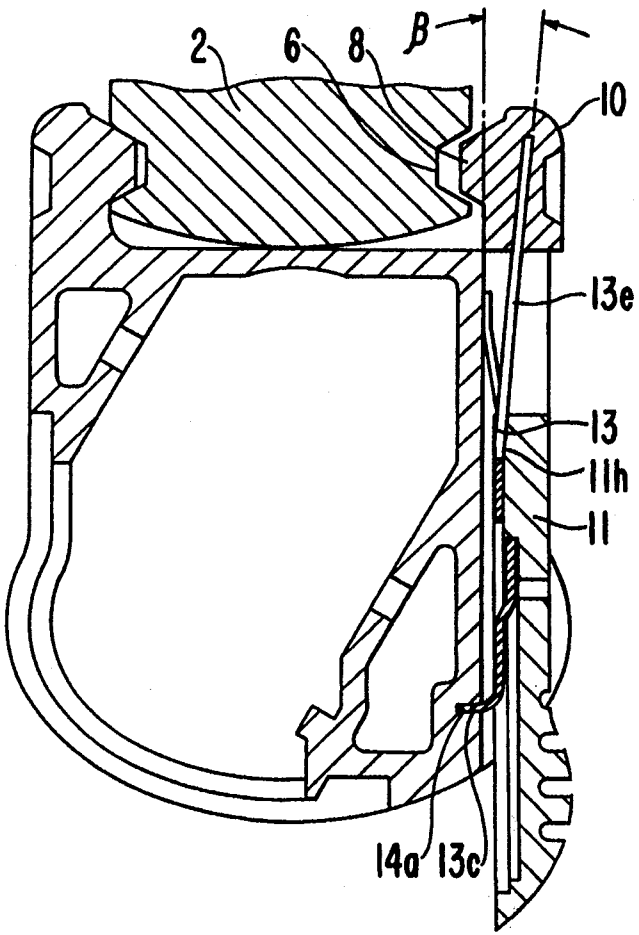
FIG. 5B shows the aiming assistance device in an open state.
Figure 5A:
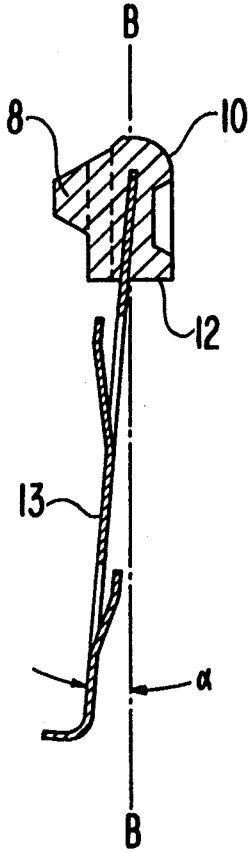
FIG. 5A shows a retaining member separate from the aiming assistance device.

Referring to FIG. 5A, for illustration purposes only, a bottom surface 12 of second side flange 10 defines a horizontal axis. Line B—B defines a vertical axis. Flexible member 13 and flange 10 are preferably coupled such that member 13 enters flange 10 at an angle $\alpha$ of about 4° from vertical.

As shown in FIG. 5B, when end portion **13*c* is inserted into groove 14*a*, and projection 8 engages groove 6 of weapon 2, an upper portion 13*e* of member 13 is angularly displaced from inner surface 14*b* of slot 14. Thus, when housing 3 is attached to weapon 2, member 13** has an associated spring force created by its angular displacement. When the assembly is in an unlocked state, as shown in FIG. 5B, the angular displacement, represented by angle $\beta$, is preferably about 6°.

Retaining member 11 is slidably disposed in slot 14 between flexible member 13 and outer surface **14*c* of slot 14, such that retaining member 11 may be selectively slid between an open and a closed position. When retaining member 11 is slidably disposed in slot 14, back face 11*b* of retaining member 11 faces member 13. As shown in FIG. 5C, when retaining member 11 is slid upward, projection 8 of flange 10 is securely forced into groove 6 of weapon 2**. The angular displacement $\beta$, when the assembly is in a closed position, as shown in FIG. 5C, is preferably about 5°.

Because slanted portion **11*h* is slanted with respect to first recessed portion 11*f*, a clearance is thereby provided for the angular displacement of member 13 as described above. Also, bottom surface 12 of second side flange 10 also prevents further upward motion of retaining member 11, such that retaining member 11, once installed, is prevented from being slid completely upward and out of slot 14. Illuminator 1 is thereby securely affixed to weapon 2 such that motion of housing 3 relative to weapon 2 is impeded. As shown in FIG. 2, grooves 6 and projections 7, 8 have dimensions such that first and second spaces 30, 31 are formed when first and second projections 7, 8 are fixedly maintained within grooves 6**.

Illuminator 1 is preferably further constrained in an axial direction by front surface **2*b* of trigger guard 2*a* of weapon 2 and by closed ends 6*b* of grooves 6. Illuminator 1 may also be axially constrained by closed ends 6*a*. Illuminator 1 is designed to fit precisely with these features to prevent motion of illuminator 1 relative to weapon 2**, e.g. motion caused by firing or other vibration.

To assist in maintaining retaining member 13 in a fully closed position, notches **17*a* formed in front face 11*a* of retaining member 11 engage notches 18 formed in an outer surface 14c of slot 14. As best seen in FIGS. 4B and 4D, a width B of slot 14 is preferably slightly greater than a width A of flange 17. Accordingly, width A should be approximately 0.20" less than width B. Spring tab 13a biases notches 17a against notches 18. Concurrently, the spring force of member 13 biases notches 17a against notches 18. Notches 17a and 18 thereby remain engaged until retaining member 11 is pushed inwardly toward surface 14b against the spring forces of member 13 and spring tab 13a. The difference in width A and B preferably allows notches 17a to disengage from notches 18, thus allowing retaining member 11 to be slid downward within slot 14**.

As retaining member 11 is slid downward, spring tab 13b forces flexible member 13 away from inner surface 14b of slot 14, thereby disengaging first and second projections 7, 8 from grooves 6. Concurrently, the flexibility of member 13 is increased such that member 13 may move away from inner surface 14b of slot 14. First and second projections 7, 8 may thereby be disengaged from grooves 6, thus releasing illuminator 1 from weapon 2.

Back face 11b has second recessed portion lid formed therein. As retaining member 11 is slid downward, top portion 13d of spring tab 13a engages end portion 11e of second recessed portion lid of back face 11b to limit downward movement. Once installed, retaining member 11 cannot normally be slid out of slot 14 because of these constraints. However, a small hole 11c may be provided in retaining member 11. A tool (not shown), e.g. one end of a paper clip, may be inserted through small hole 11c, forcing top portion 13d of spring member 13a away from end portion lie of recessed portion lib, thereby allowing retaining member 11 to be slid completely out of slot 14. Thereafter, member 13 may be easily removed from slot 14. This tool, however, is not necessary for attaching or detaching the auxiliary device to or from the weapon. Instead, this feature is provided to aid in disassembling the device itself. Accordingly, flexible member 13, with associated flange 10, is simply positioned in slot 14. Retaining member 11 is then easily slid upward into slot 14 until notches 17a engage notches 18 in a locked position.

The foregoing details are merely provided to illustrate one means of achieving the side flange retraction capability and clamping action of the present invention. Numerous other ways of accomplishing such retraction capability and clamping action are also envisioned including, but not limited to, a spring-loaded rocker mechanism. Further, it should be noted that the location of first and second side flanges 9, 10 may be switched. Moreover, although grooves 6 are the recessed portions of the weapon which are described as receiving first and second projections 7, 8, these recessed portions may take on any variety of shapes corresponding to the shape of first and second projections 7, 8.

It should be noted that while the clamping mechanism described above has grooves 6 located on weapon 2 and projections 7, 8 located on illuminator 1, the respective placement of the grooves and projections could be switched. In other words, grooves 6 could be located on illuminator 1 with corresponding projections formed on weapon. 2. Also, if weapon 2 does not have grooves, a separate adaptor structure (not shown) may be provided with grooves. This separate structure could then be attached to weapon 2 by any suitable attachment mechanism and projections 7, 8 of illuminator 1 could then be received in these grooves to attach illuminator 1 to weapon 2. Other alternatives are also envisioned.

Figure 6:
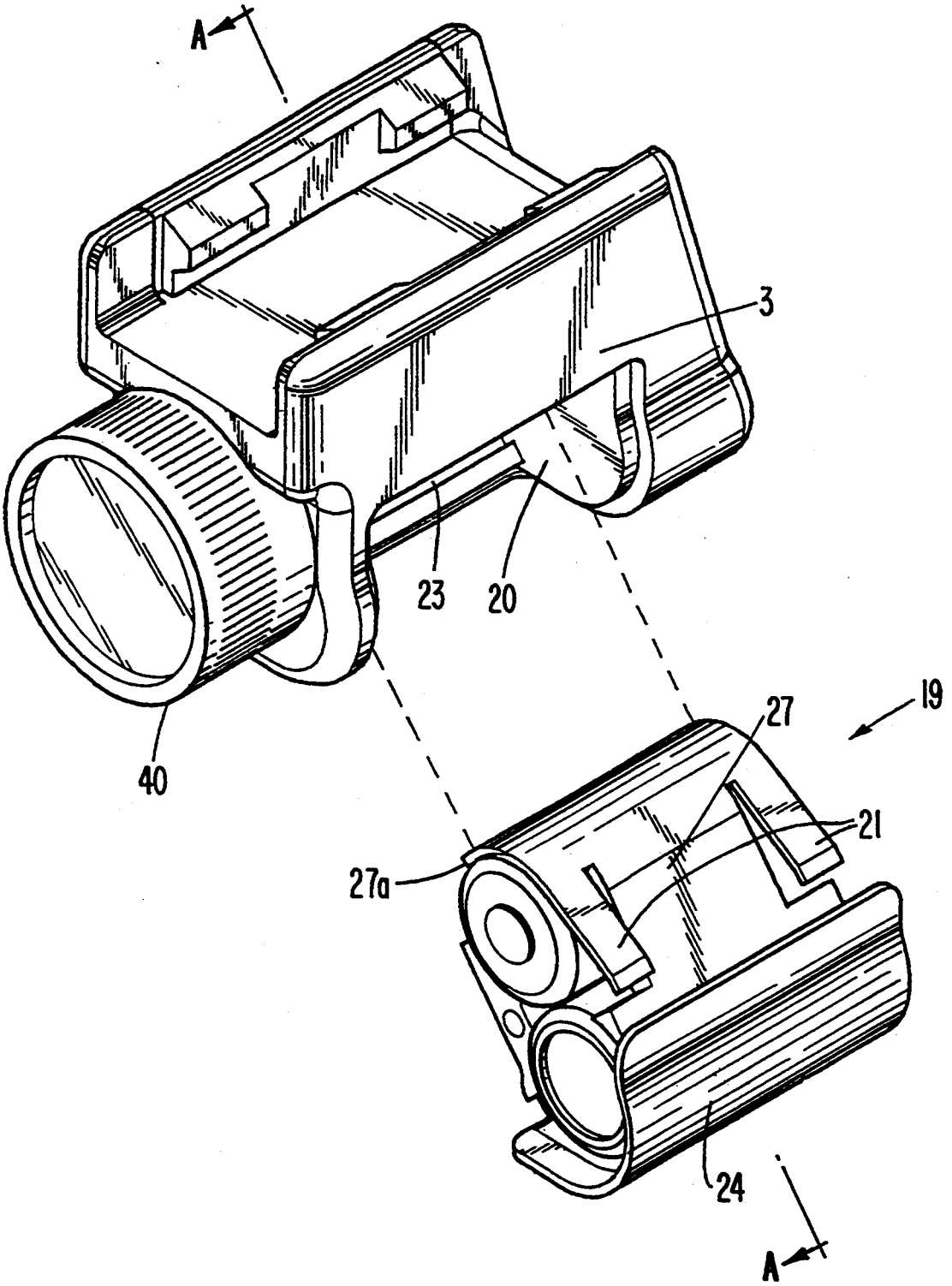
FIG. 6 is an exploded perspective view of an aiming assistance device in accordance with an embodiment of the present invention.

According to another aspect of the present invention, housing 3 is designed to compactly store batteries and allow the batteries to be easily and readily replaced. Referring to FIGS. 6–7, battery casing 19 is provided for holding one or more batteries for energizing illuminator 1. As described in greater detail below, battery casing 19 may be easily inserted into and removed from housing 3 in order to replace the batteries.

Battery casing 19 is preferably a one-piece molded structure and has first portion 24 with second portion 27 extending therefrom. Preferably, second portion 27 is a relatively thin-walled, substantially U-shaped portion capable of holding one or more batteries. As best seen in FIG. 7, second portion 27 may have opening 27a formed therein for allowing a side surface of a battery to partially protrude from battery casing 19. Alternately, battery casing 19 may be formed without opening 27a such that casing 19 entirely encloses the side surfaces of the batteries. Second portion 27 preferably defines open ends into which one or more batteries may be inserted. Preferably, a pair of spring members 21 are attached to, or integrally formed on, second portion 27. Battery casing 19 also has projection 22 which is preferably integrally formed thereon. Projection 22 defines projection surface 22a. Further, battery casing 19 has a leading edge 26.

Housing 3 has a cavity 20, preferably integrally formed therein, for receiving battery casing 19. A notch 23 is formed on the surface of cavity 20 and defines retaining surface 23a. Cavity 20 may have a depression 25 formed on the surface thereof.

Figure 7A:
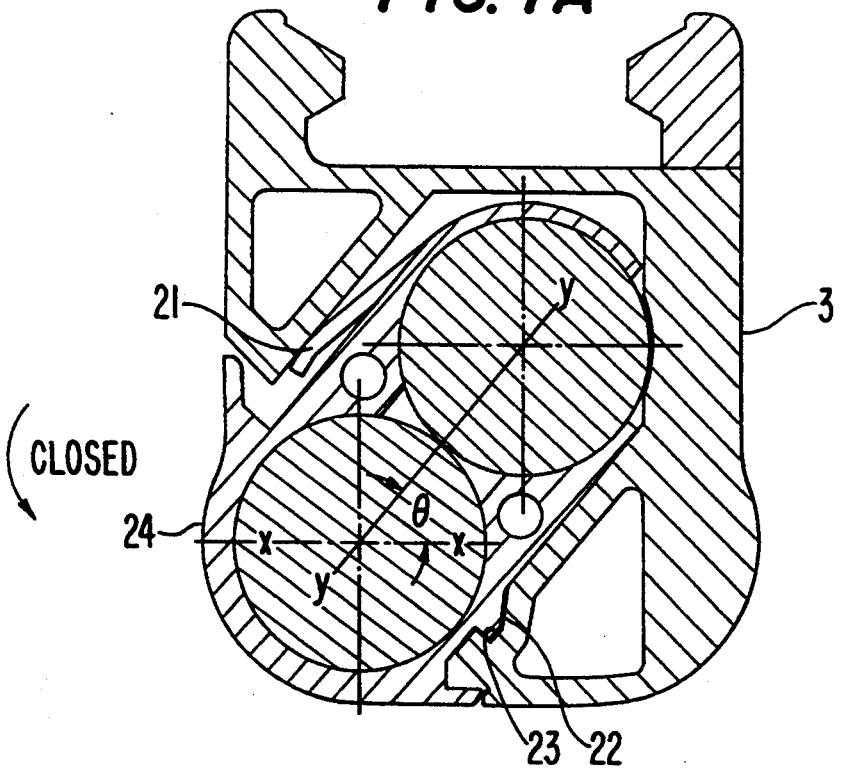
FIG. 7A shows a battery casing in a closed state.

Battery casing 19 is inserted into cavity 20 such that first portion 24 remains exterior to cavity 20. As shown in FIG. 7A, when battery casing 19 is inserted into cavity 20, projection surface 22a of projection 22 passes retaining surface 23a of notch 23. Concurrently, spring members 21 tend to force projection 22 toward notch 23. As projection surface 22a passes retaining surface 23a, projection 22 is received in notch 23. When battery casing 19 is inserted, leading edge 26 of battery casing 19 preferably engages the surface of cavity 20. As projection 22 is being received in notch 23, battery casing 19 preferably rotates about the point where leading edge 26 engages the surface of cavity 20. In the embodiment depicted in FIG. 7, this rotation should cause a side surface of a battery to engage depression 25 (if depression 25 is provided). Alternately, in the embodiment depicted in FIG. 7C, in which battery casing 19 entirely encloses the side surfaces of the batteries, the above rotation preferably causes another portion of battery casing 19 to engage the surface of cavity 20 (or depression 25 if provided). These features preferably ensure that projection surface 22a engages retaining surface 23a, thereby securely fixing battery casing 19 in cavity 20 of housing 3.

Figure 7B:
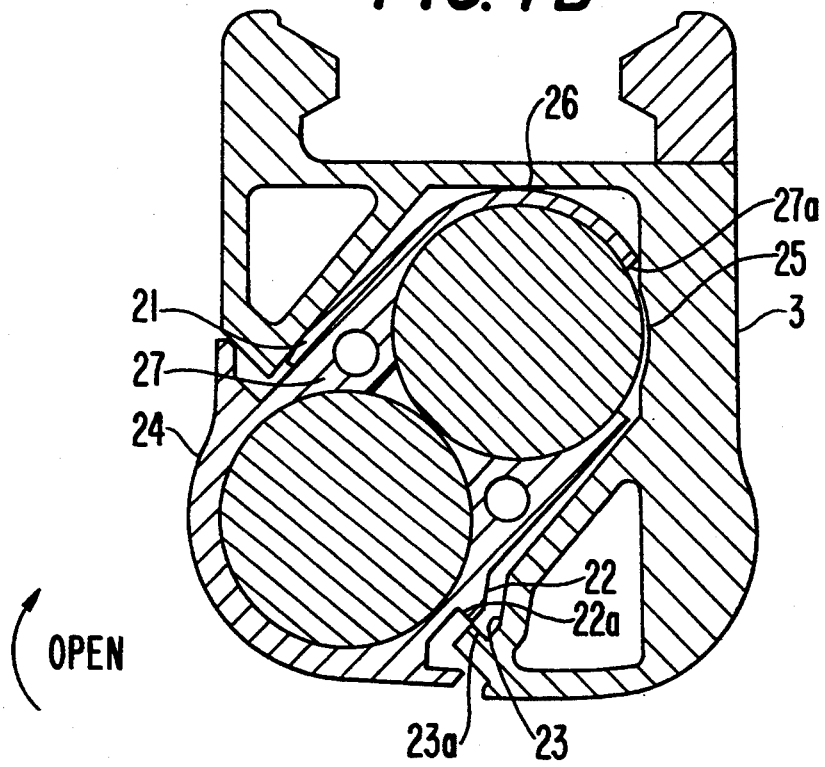
FIG. 7B shows a battery casing in an open state.

As shown in FIG. 7B, when first portion 24 of battery casing 19 is rotated in a direction away from notch 23 and against the force of spring members 21, spring members 21 are depressed, thus allowing projection surface 22a and retaining surface 23a to disengage. Battery casing 19 can thereby be removed from cavity 20 of housing 3. It should be noted that the orientation of spring members 21 depicted in FIG. 7 is for illustrative purposes only. Spring members 21 can easily be located anywhere on the surface of battery casing 19, so long as the placement of projection 22 and notch 23 is such that spring members 21 tend to force projection 22 toward notch 23.

Also, it is envisioned that spring members 21 may be attached to, or integrally formed on, the surface of cavity 20, thereby engaging the surface of battery casing 19 and tending to force projection 22 toward notch 23. Further, spring members 21 may be integrated elements, e.g. springs, which engage both cavity 20 and battery casing 19. Moreover, spring members 21 may constitute one or more elements. Also, the pressure tending to force projection 22 toward notch 23 may be supplied by an flexible portion of battery casing 19 which engages the surface of cavity 20. As depicted in FIGS. 6–7, battery casing 19 is a one-piece molded part. It is envisioned that battery casing 19 may constitute multiple parts. Further, the above-described features preferably allow replacement of the batteries without detaching housing 3 from weapon 2.

As shown in FIGS. 6–7, a pair of batteries are provided, such that when battery casing 19 is inserted into cavity 20 the batteries are preferably both horizontally and vertically displaced from each other. Thus, the batteries are diagonally adjacent to each other in a side-by-side relationship as opposed to an end-to-end relationship. It is intended that this arrangement is preferable to an end-to-end arrangement which would typically result in an overall greater length of the auxiliary device.

Further, the diagonal placement is preferable to the solely horizontal or solely vertical side-by-side placement which would typically result in a larger overall width and/or height of the auxiliary device. Thus, the preferred orientation of the batteries within battery casing 19, when battery casing 19 is inserted into housing 3, is such that the overall dimensions of the auxiliary device are minimized. Accordingly, as seen in FIG. 7A, line X—X bisects a first battery and defines a horizontal axis. Line Y—Y is a line from a center of the first battery to a center of a second battery. Angle $\theta$ is shown as an acute angle defined by lines X—X and Y—Y. Preferably, when battery casing 19 is installed, angle $\theta$ is 60°, such that housing 3 will be compact. Although the preferred arrangement of batteries is as described above, various orientations are envisioned for holding one or more batteries in battery casing 19.

In this description of the preferred embodiments, an illuminator is described as the device attached to the weapon. Also, the weapon depicted in FIG. 1 is a pistol-type weapon. It will be appreciated by those with ordinary skill in the art that the device being attached to the weapon could be a device other than an illuminator. For instance the device may be any auxiliary apparatus including, but not limited to, a laser, an illuminator/-laser combination, and a scope. Similarly, while a pistol is depicted in FIG. 1 as the weapon to which the auxiliary apparatus is attached, it is obvious that a rifle, shotgun, or other weapon could be the weapon to which the auxiliary apparatus is attached. Moreover, the features described herein may be used to attach the auxiliary apparatus to other non-weapon frames including, but not limited to, helmets, bicycles, automobiles, and belts.

Additionally, the above-described features have non-weapon related applications related to the attachment of various auxiliary devices to a variety of frames. Such applications may include, but are not limited to, attaching various auxiliary devices, e.g. tire pumps, water bottle cages, and lights to bicycles or other frames.

In each of the embodiments described above, the dimensions of the auxiliary device are preferably such that the width of the auxiliary device is minimized. Where auxiliary devices are attached to frames having front ends, e.g. the frame of the pistol type weapon depicted in FIG. 1, it is also preferable that the dimensions of the auxiliary device are such that protrusion of the device beyond the front end of the frame is minimized. Referring to FIGS. 1–2, for example, it is preferable that the width of housing 3, at its widest point, does not exceed the width of frame 4 of weapon 2 measured at its widest point. Moreover, it may be advantageous if the width of housing 3 at its widest point does not exceed the width of slide 2c of weapon 2 measured at the widest point of slide 2c. Further, the device preferably does not protrude beyond the front end of weapon 2.

The auxiliary device according to the present invention may also be provided with other features. For example, an on/off switch may be provided on housing 3 for selectively turning on and off the light source. Further, a remote switch assembly commonly known in the art may be provided. According to this feature, a receptacle may be formed in housing 3 for receiving an operative switching mechanism of the remote switch assembly.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby, but is to be determined by the claims which follow.

We claim:

1. An aiming assistance device for assisting the aiming of a weapon, said aiming assistance device comprising:

a battery casing having at least one projection extending from a surface thereof;

a battery housing having a cavity formed therein for receiving said battery casing;

at least one recessed portion formed in a surface of said cavity; and biasing means for biasing said at least one projection against said at least one recessed portion, such that said battery housing is in a closed state when said at least one projection is received in said at least one recessed portion.

2. The aiming assistance device of claim 1, said biasing means comprising a flexible member formed integrally with said battery casing.

3. The aiming assistance device of claim 1, said biasing means comprising a flexible portion of said battery casing.

4. The aiming assistance device of claim 1, said biasing means comprising a flexible member formed integrally with said battery housing.

5. The aiming assistance device of claim 7, wherein the cavity is at least partially defined by an inner surface of the housing, and the inner surface of said housing has a depression formed therein, said depression snugly engaging a corresponding surface of said battery casing when said battery casing is positioned in said battery housing.

6. The aiming assistance device of claim 1, wherein the cavity is at least partially defined by an inner surface of the housing, and the inner surface of said housing has a depression formed therein, said depression snugly engaging a corresponding surface of at least one battery when said battery housing is in a closed state.

7. The aiming assistance device of claim 1, wherein the weapon has a front and rear end, said aiming assistance device further comprises a first end surface located between the front end of the weapon and the rear end of the weapon.

8. The aiming assistance device of claim 7, wherein the width of said aiming assistance device is at least as narrow as the width of the weapon.

9. The aiming assistance device of claim 7, wherein the width of the weapon is measured at the widest point of the weapon.

10. The aiming assistance device of claim 7, wherein the weapon has a slide and wherein the width of the weapon is measured at the widest point of the slide.

11. The aiming assistance device of claim 1, wherein the aiming assistance device is energized by at least two batteries each having a front end, a rear end, and a tubular side surface connecting the front and rear ends, said battery casing formed to receive the at least two batteries such that the side surfaces of the at least two batteries are adjacent.

12. The aiming assistance device of claim 1, said battery casing formed to receive the at least two batteries such that at least one of the at least two batteries is elevated with respect to another of the at least two batteries.

13. An auxiliary light assembly attachable to a weapon, said light assembly comprising:

a light housing comprising a light located in the light housing to assist in aiming the weapon;

a flexible member attached to the light housing and having a free length;

a projection engageable with the weapon and connected to the flexible member; and biasing means for biasing the projection, the biasing means comprising means for changing the free length of the flexible member to vary the bias on the projection.

14. An auxiliary light assembly attachable to a weapon, said auxiliary light assembly comprising:

a light housing comprising a light located in the light housing;

a snap-on clamping mechanism for attaching the light housing to the weapon, the clamping mechanism comprising at least one projection engageable with the weapon; and a locking mechanism comprising a linearly movable slide member for selectively locking the projection into engagement with the weapon.

15. The light assembly of claim 14, wherein the light housing is attachable to the weapon by moving the light housing in a direction towards the weapon and the slide member is movable in the same direction to lock the projection into engagement with the weapon.

16. An auxiliary light assembly attachable to a weapon, said auxiliary light assembly comprising:

a light housing comprising a light located in the light housing;

a flexible member attached to the light housing and having a free length;

a projection engageable with the weapon and connected to the flexible member; and a linearly movable locking mechanism for selectively locking the projection into engagement with the weapon;

wherein the flexible member is positioned between the aiming light housing and the locking mechanism.

* * * * *